US005970838A

United States Patent [19]

Perazzolo

[11] Patent Number: 5,970,838

[45] Date of Patent: Oct. 26, 1999

[54] MACHINE FOR PUNCHING SHEET METAL WITH A COUNTERPUNCH EXTRACTING MEANS

[75] Inventor: Eugenio Perazzolo, Rovigo, Italy

[73] Assignee: Rainer S.r.l., Italy

[21] Appl. No.: 08/997,261

[22] Filed: Dec. 23, 1997

[30] Foreign Application Priority Data

Dec. 27, 1899 [IT] Italy ..... TO96A1094

[51] Int. Cl.[6] ..... B26D 5/08

[52] U.S. Cl. ..... 83/552; 83/559; 83/564

[58] Field of Search ..... 83/552, 690, 698.91, 83/527, 684, 685, 559, 564

[56] References Cited

U.S. PATENT DOCUMENTS

| | | | |
|---|---|---|---|
| 316,935 | 5/1885 | Barrath | 83/527 |
| 1,988,935 | 1/1935 | Bollaert | 83/552 |
| 2,217,560 | 10/1940 | Michon | 83/689.91 X |
| 2,364,401 | 12/1944 | Stellin | 83/698.91 X |
| 2,382,267 | 8/1945 | Stellin | 83/698.91 X |
| 2,393,986 | 2/1946 | Gullberg | 83/698.91 X |
| 2,431,566 | 11/1947 | Kopczynski | 83/698.91 X |
| 2,999,407 | 9/1961 | De Frangesco | 83/698.91 X |
| 3,195,386 | 7/1965 | Daniels | 83/685 X |
| 3,289,519 | 12/1966 | Piccone | 83/698.91 X |
| 3,610,082 | 10/1971 | Riggi et al. | 83/527 X |
| 3,641,860 | 2/1972 | Whistler, Sr. et al. | 83/527 X |
| 4,487,566 | 12/1984 | Barna | 83/684 X |
| 4,624,165 | 11/1986 | Bredow et al. . | |
| 5,346,454 | 9/1994 | Hayashi | 83/552 X |
| 5,522,295 | 6/1996 | Chun | 83/552 |
| 5,545,116 | 8/1996 | Seto . | |
| 5,616,112 | 4/1997 | Seto et al. | 83/552 X |

FOREIGN PATENT DOCUMENTS

| | | | |
|---|---|---|---|
| 0 388 644 | 2/1990 | European Pat. Off. . | |
| 0 530 813 | 9/1992 | European Pat. Off. . | |
| 2070492 | 9/1981 | United Kingdom | 83/552 |

*Primary Examiner*—M. Rachuba

*Attorney, Agent, or Firm*—Shlesinger, Arkwroght & Garvey, LLP

[57] ABSTRACT

A machine for punching sheet metal includes a counterpunch holder unit including a supporting disk mounted for rotation about a main axis and supporting a number of counterpunch holder assemblies, each including a respective counterpunch. Each counterpunch holder assembly includes a main body secured to the supporting disk. Each main body includes a seat, which extends coaxially with the main body axis which is parallel to the main axis. Each counterpunch holder assembly further includes an extracting body housed in an axially-movable manner inside the seat to support the bottom of the respective counterpunch. A positive actuating assembly moves the extracting body axially to extract the counterpunch from the respective seat.

7 Claims, 3 Drawing Sheets

MACHINE FOR PUNCHING SHEET METAL WITH A COUNTERPUNCH EXTRACTING MEANS

BACKGROUND OF THE INVENTION

The present invention relates to a sheet metal punching machine.

Currently known sheet metal punching machines comprise a frame; a work table supported on the frame; and a punching unit located over the work table at a work station. The punching unit comprises a counterpunch holder unit located beneath the work table at the work station; a ram located over the work table at the work station; and a punch holder unit located over the work table, between the ram and the counterpunch holder unit.

The counterpunch holder unit comprises a supporting disk, which is located beneath and parallel to the work table and supports a number of counterpunch holder assemblies, each fitted integrally with at least a respective counterpunch. The supporting disk is rotated in steps about an axis of rotation perpendicular to the work table to position a respective counterpunch at the work station.

Similarly, the punch holder unit comprises a respective supporting disk, which is located over and parallel to the work table and supports a number of punch holder assemblies, each fitted integrally with at least a respective punch. The supporting disk is rotated in steps about an axis of rotation perpendicular to the work table to position a respective punch at the work station.

At the work station, the ram, punch and counterpunch are aligned along a common axis perpendicular to the work table; and known machines also comprise a sheet handling device for positioning a sheet between the punch and the counterpunch at the work station.

In the course of a normal operating cycle, machines of the above type require replacement of some of the punches and/or counterpunches, which must be done with the machine at rest. For which purpose, machines of the above type may feature a manipulating assembly to facilitate removal and replacement of the punches and/or counterpunches.

The main drawback of such machines is the amount of work and downtime involved in replacing the counterpunches, which may weigh heavily on the running cost of the machine.

While reducing downtime, which nevertheless is still considerable, currently known manipulating assemblies seriously complicate the structure of the machine, thus frequently impairing reliability and greatly increasing production cost. Such assemblies in fact are extremely complicated and expensive, and are subject to breakdowns which in themselves prevent the machine from being operated.

SUMMARY OF THE INVENTION

It is an object of the present invention to provide a sheet metal punching machine designed to overcome the aforementioned drawbacks.

According to the present invention, there is provided a machine for punching sheet metal, comprising a frame, a work table supported on said frame, a number of counterpunches, and a counterpunch holder unit; said counterpunch holder unit comprising a movable supporting element, and at least one counterpunch holder assembly supported by said supporting element and housing at least a respective counterpunch; said machine being characterized in that said counterpunch holder assembly comprises a main body integral with said supporting element having a seat for housing at least a said counterpunch; and extracting means housed at least partially inside said main body, which selectively move said counterpunch axially to extract the counterpunch at least partially from said seat.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
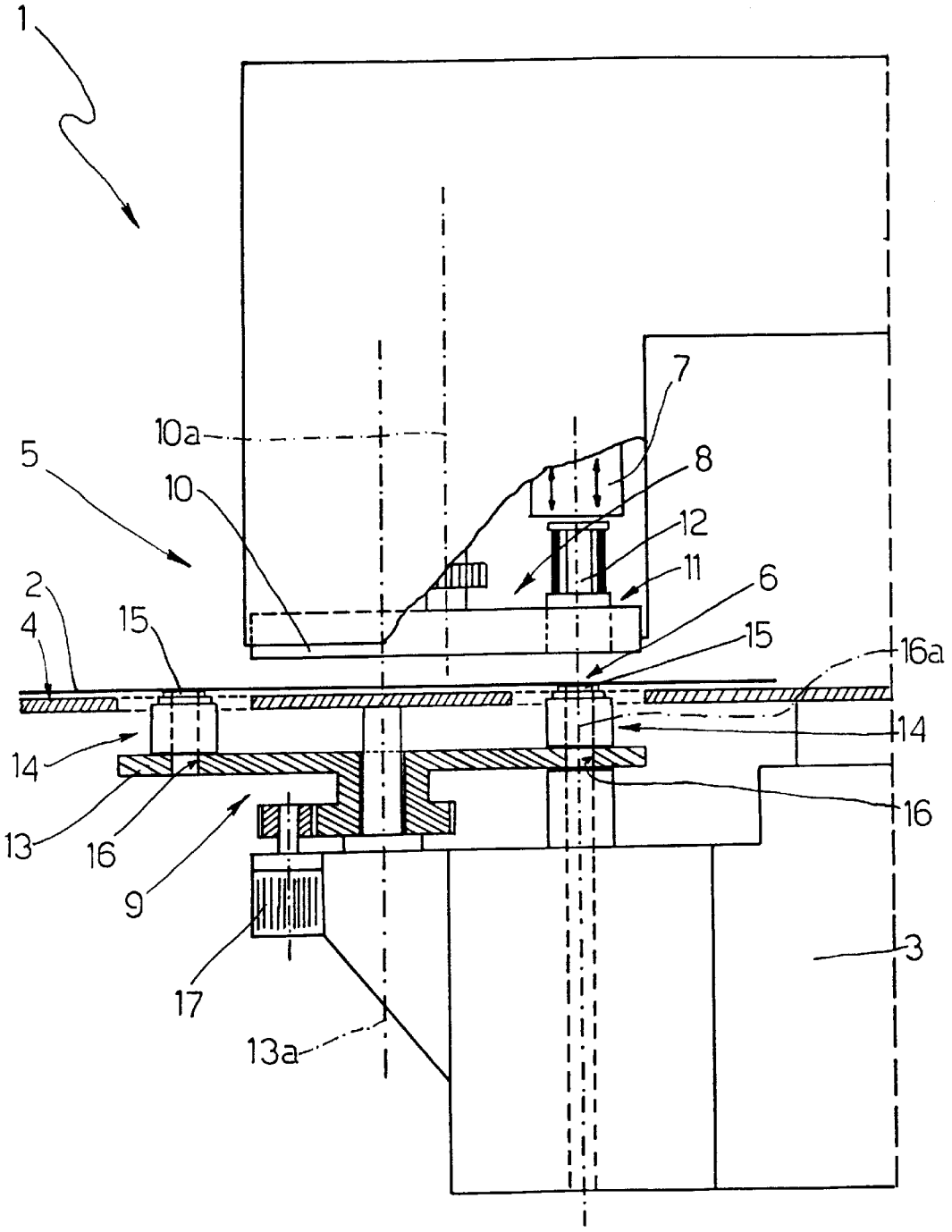
FIG. 1 shows a front view, with parts in section and parts removed for clarity, of a punching machine in accordance with the teachings of the present invention.

Number 1 in FIG. 1 indicates, as a whole, a machine tool for punching a metal sheet 2. Machine 1 comprises a frame 3; a horizontal work table 4; a punching unit 5 located over the work table at a work station 6; a known device (not shown) for handling sheet 2 at work station 6; and a known control unit (not shown) comprising an electronic central unit for controlling the handling device and punching unit 5.

Punching unit 5 comprises a known ram 7 located over work table 4 at work station 6; a known punch holder unit 8 located over work table 4 at work station 6; and a counterpunch holder unit 9 located beneath work table 4 and at least partly facing punch holder unit 8 at work station 6. The travel of ram 7 is controlled by said control unit.

Punch holder unit 8 comprises a supporting disk 10 mounted over work table 4, coaxially with an axis 10*a* substantially perpendicular to work table 4, and which supports a number of known punch holder assemblies 11, each having at least a respective punch 12. Supporting disk 10 is rotated in steps about axis 10*a* to position a punch holder assembly 11 and respective punch 12 at work station 6.

Similarly, counterpunch holder unit 9 in turn comprises a supporting disk 13 mounted beneath work table 4, coaxially with an axis 13*a* substantially perpendicular to work table 4, and which supports a number of counterpunch holder assemblies 14, each housing at least a respective counterpunch 15 (also known as a "die").

More specifically, supporting disk 13 comprises a number of through holes 16 arranged along the periphery of supporting disk 13, and extending coaxially with respective axes 16*a* parallel to axis 13*a*. Each counterpunch holder assembly 14 is fixed to supporting disk 13 in line with a respective through hole 16; and supporting disk 13 is connected to an electric gearmotor 17 controlled by said control unit to rotate supporting disk 13 in steps about axis 13*a* and position one of the counterpunch holder assemblies 14 together with the respective counterpunch 15 at work station 6.

With reference to FIG. 1, axis 10*a* and axis 13*a* are parallel and preferably, but not necessarily, noncoincident, so that supporting disks 10 and 13 face each other only partially. In this case, supporting disk 13 faces supporting disk 10 at work station 6, and has a portion not facing supporting disk 10 and therefore directly accessible.

At work station 6, ram 7, punch 12 and counterpunch 15 are aligned along a common axis perpendicular to work table 4, and said device for handling sheets 2 provides for positioning a sheet 2 between punch 12 and counterpunch 15 at work station 6.

Figure 2:
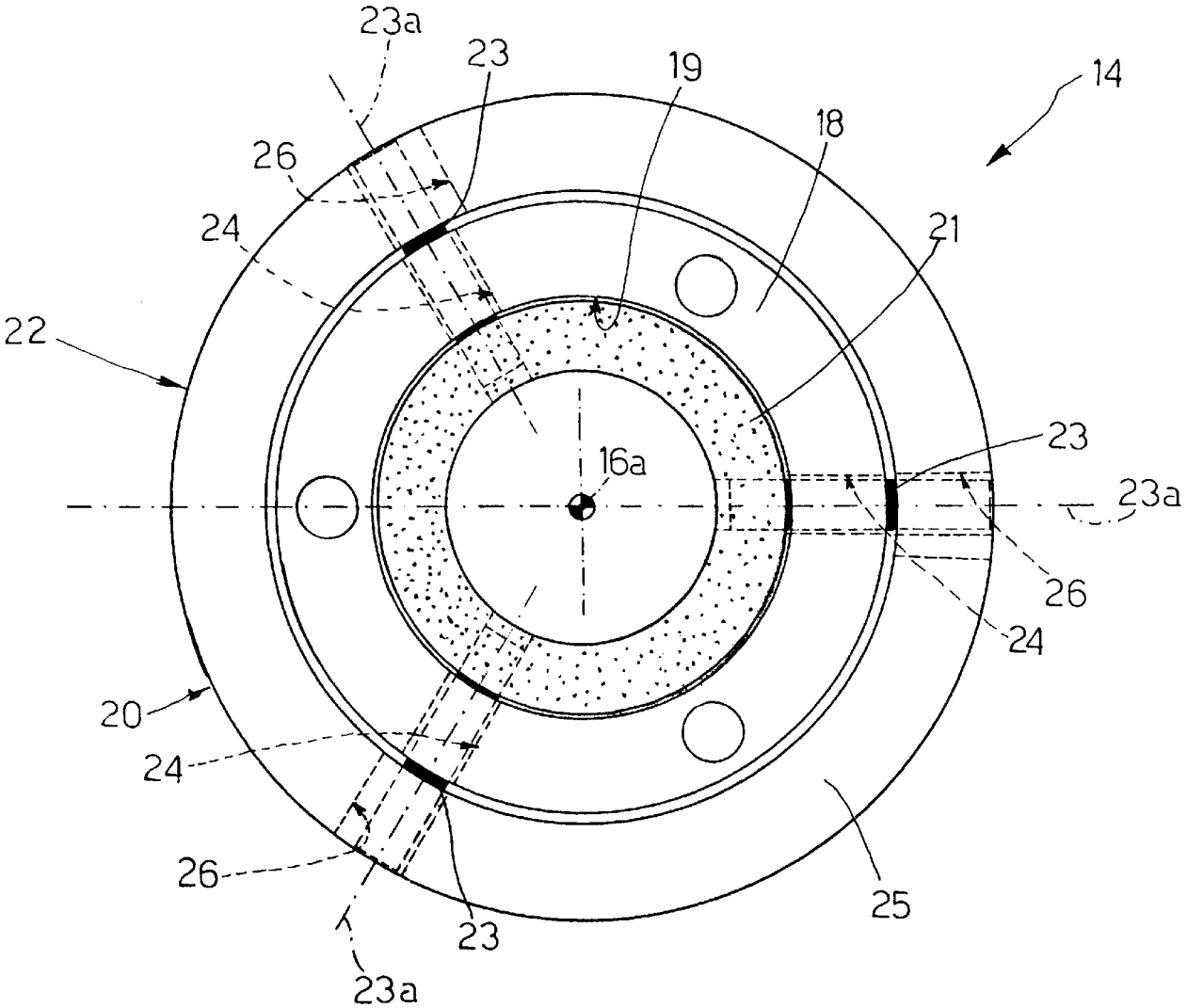
FIG. 2 shows a plan view, with parts removed for clarity, of the details of the counter punch in FIG. 1 machine.
Figure 3:
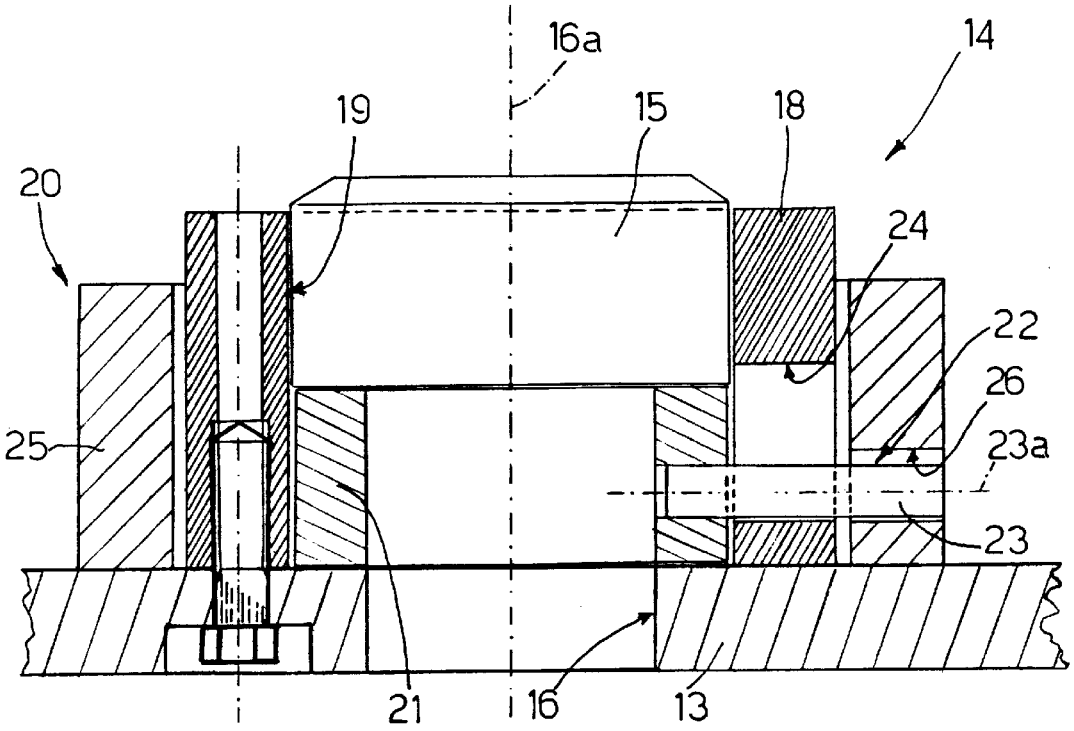
FIG. 3 shows a front view, with parts in section and parts removed for clarity, of the FIG. 2 detail.
Figure 4:
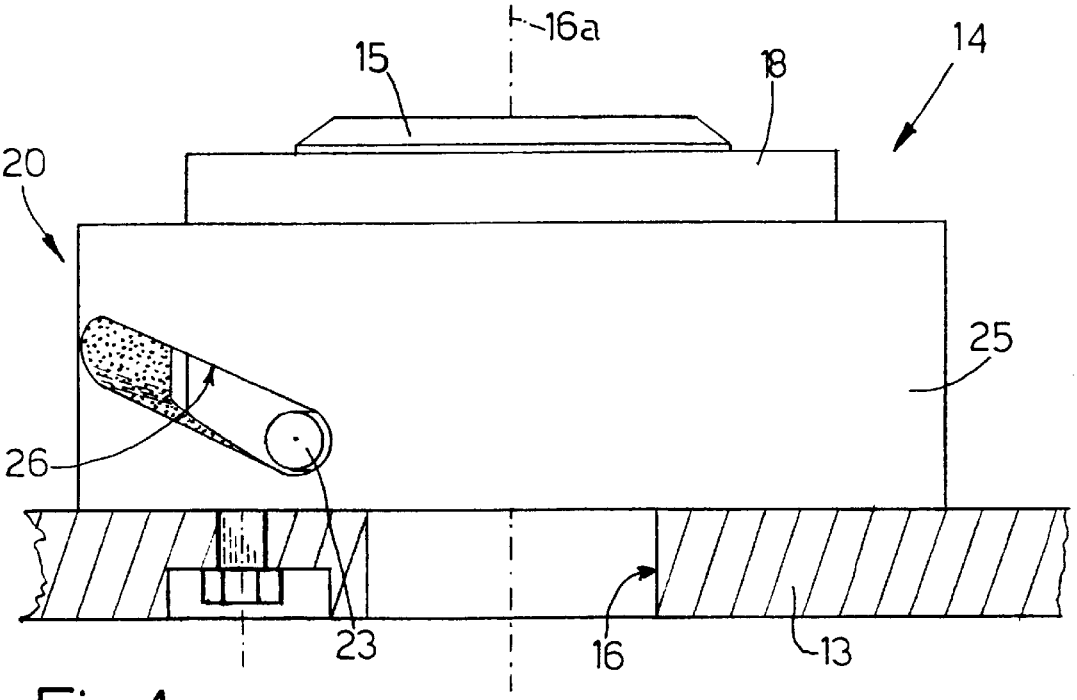
FIG. 4 shows a front view of the FIG. 2 detail.

With reference to FIGS. 2, 3 and 4, each counterpunch holder assembly 14 comprises a supporting body 18, which is integral with supporting disk 13, extends from supporting disk 13 coaxially with axis 16*a* of corresponding through hole 16, and comprises a central seat 19 for housing at least a respective counterpunch 15.

In the example shown, supporting body 18 is cylindrical and fitted to supporting disk 13 by means of screws; and seat 19 is also substantially cylindrical, extends the whole length of supporting body 18, and communicates with corresponding through hole 16. In the example shown, each counterpunch 15 is obviously of cylindrical shape to engage seat 19.

Each counterpunch holder assembly 14 also comprises an extracting device 20 for at least partially extracting counterpunch 15 from respective seat 19.

Extracting device 20 comprises an extracting body 21 housed inside seat 19 to support the bottom of counterpunch 15; and a positive actuating assembly 22 for moving extracting body 21 axially inside seat 19 to raise or lower counterpunch 15 and so vary the position of counterpunch 15 inside seat 19. More specifically, extracting body 21 is movable between an operating position (FIG. 3) in which counterpunch 15 engages seat 19 almost completely, and a change position in which counterpunch 15 projects from seat 19 almost completely to assist extraction of counterpunch 15 from seat 19.

In the example shown, extracting body 21 is a cylindrical tubular body with an outside diameter approximately equal to but no greater than the diameter of seat 19.

Actuating assembly 22 comprises a number of angularly-spaced pins 23, each of which extends from extracting body 21 coaxially with a respective axis 23*a* perpendicular to axis 16*a*, engages in sliding manner a respective opening 24 formed in the lateral wall of supporting body 18, and projects outwards of supporting body 18. Each opening 24 in the lateral wall of supporting body 18 extends parallel to axis 16*a*.

Actuating assembly 22 also comprises a tubular guide body 25—in the example shown, cylindrical—which is fitted coaxially with axis 16*a* outside supporting body 18, and in turn comprises, in a lateral wall facing supporting body 18, a number of openings 26, each engaged by a respective pin 23. Each opening 26 in the lateral wall of tubular guide body 25 extends along a preferably, but not necessarily, helical path, so that rotation of tubular guide body 25 about axis 16*a* causes pins 23 and extracting body 21 to translate parallel to axis 16*a*.

In a variation not shown, tubular guide body 25 has no openings 26, openings 24 in supporting body 18 extend in a plane perpendicular to axis 16*a*, and the lateral wall of extracting body 21 has a number of helical grooves, and possibly a guide for preventing rotation of extraction body 21 about axis 16*a*. In this variation, pins 23 extend from tubular guide body 25, and each engages a respective opening 24 in supporting body 18 and a respective groove in extracting body 21, so that rotation of tubular guide body 25 about axis 16*a* causes pins 23 and extracting body 21 to translate parallel to axis 16*a*.

In a further variation not shown, actuating assembly 22 has no tubular guide body 25, and openings 24 in the lateral wall of supporting body 18 extend along a preferably, but not necessarily, helical path, so that rotation of extracting body 21 about axis 16a causes pins 23 and extracting body 21 to translate parallel to axis 16*a*.

Operation of machine 1 and extracting devices 20 is clearly understandable from the foregoing description with no further explanation required.

The main advantage of machine 1 lies in each counterpunch holder assembly 14 having an extremely straightforward, low-cost extracting device 20 for extracting counterpunch 15, and which greatly reduces the manufacturing cost of machine 1, and provides for extremely fast replacement of counterpunch 15 to drastically reduce the downtime of machine 1.

More specifically, counterpunch holder assemblies 14 with respective extracting devices 20 are extremely advantageous in the event axes 10*a* and 13*a* are noncoincident, in which case, counterpunches 15 are replaced rapidly with no need to move or dismantle any other parts of machine 1.

Clearly, changes may be made to the machine as described and illustrated herein without, however, departing from the scope of the present invention.

What is claimed is:

1. A machine for punching sheet metal, comprising:

a) a frame;

b) a work table supported on said frame;

c) a number of counterpunches;

d) a counterpunch holder unit;

e) said counterpunch holder unit comprising a moveable supporting element, at least one counterpunch holder assembly supported by said supporting element and housing at least a respective counterpunch;

f) said counterpunch holder assembly comprising a main body secured to said supporting element and having a seat for housing a respective counterpunch, and an extractor disposed partially within said main body, said seat extending coaxially with a first axis substantially perpendicular to said work table;

g) said extractor comprising an extracting body engaging a portion of said seat, said extracting body being movable axially within said seat, the respective counterpunch being disposed within said seat as to be supported at its bottom by said extracting body;

h) said extractor further comprising an actuating assembly for axially moving said extracting body to move the respective counterpunch parallel to said first axis and between an operating position in which substantially the whole length of the respective counterpunch engages said seat, and a change position in which substantially the whole length of the respective counterpunch projects from said seat;

i) said actuating assembly comprising at least one guide pin extending from said extracting body coaxially with a second axis substantially perpendicular to said first axis, and engaging in a sliding manner a corresponding first groove formed in a lateral wall of said main body;

j) said actuating assembly comprising a tubular guide body located outside said main body and having a lateral wall including at least one second groove; and k) said at least one guide pin engaging in a sliding manner said at least one second groove so that rotation of said tubular guide body about said first axis causes said extracting body to move inside said seat parallel to said first axis.

2. A machine according to claim 1 wherein:

a) said at least one first groove extends along a substantially straight path parallel to said first axis; and b) said at least one second groove extends along a substantially helical path.

3. A machine as in claim 1, wherein said at least one first groove is a slot.

4. A machine as in claim 1, wherein said main body is cylindrical and coaxial with said first axis.

5. A machine as in claim 1, wherein said seat is substantially cylindrical and said extracting body is substantially cylindrical.

6. A machine as in claim 1, wherein said tubular guide body is a cylindrical tubular body coaxial with said first axis.

7. A machine as in claim 1, wherein;

a) said supporting element of said counterpunch holder unit comprises a supporting disk coaxial with a third axis substantially perpendicular to said work table;

b) a punch holder unit comprises a respective supporting disk coaxial with a fourth axis substantially parallel to said third axis, and supports at least one respective punch holder assembly; and c) said third axis and said fourth axis are noncoincident.

* * * * *

UNITED STATES PATENT AND TRADEMARK OFFICE

CERTIFICATE OF CORRECTION

PATENT NO. : 5,970,838
DATED : Oct. 26, 1999
INVENTOR(S) : Eugenio PERAZZOLO

It is certified that error appears in the above-identified patent and that said Letters Patent is hereby corrected as shown below:

Title page item [30],

In the Foreign Application Priority Data, replace "Dec. 27, 1899" with -- Dec. 27, 1996 --.

Signed and Sealed this

Twenty-third Day of May, 2000

*Attest:*

Q. TODD DICKINSON

*Attesting Officer*

*Director of Patents and Trademarks*